United States Patent [19]

Romero

[11] Patent Number: 4,698,852

[45] Date of Patent: Oct. 13, 1987

[54] HEAD GUARD FOR SOCCER PLAYER

[76] Inventor: Lazarito A. Romero, 3611 W. Hubbell, Phoenix, Ariz. 85009

[21] Appl. No.: 892,256

[22] Filed: Aug. 4, 1986

[51] Int. Cl.[4] ..... A41D 21/00; A63B 11/00

[52] U.S. Cl. ..... 2/171; 2/DIG. 11; 2/411

[58] Field of Search ..... 2/DIG. 6, DIG. 11, 410, 2/411, 425, 171, 24

[56] References Cited

U.S. PATENT DOCUMENTS 1,633,586 6/1927 Hunter ..... 2/171
2,546,842 3/1951 Yealdhall ..... 2/425
2,783,474 3/1957 Campagna et al. ..... 2/171
4,502,156 3/1985 Wishman ..... 2/DIG. 11

FOREIGN PATENT DOCUMENTS 2390116 12/1978 France ..... 2/DIG. 11

*Primary Examiner*—Louis K. Rimrodt
*Attorney, Agent, or Firm*—Nissle & Leeds

[57] ABSTRACT

A head guard for a soccer player. The head guard minimizes injury which can occur to the forehead of a player when contacted by a soccer ball. The head guard also enables a player to more readily control a soccer ball when bunting the ball with his head.

1 Claim, 5 Drawing Figures

HEAD GUARD FOR SOCCER PLAYER

This invention relates to apparatus for protecting the head of a player during the bunting of a soccer ball.

More particularly, the invention relates to a head guard for a soccer player which minimizes injury to the forehead of a player and enables a player to more readily control a soccer ball when he bunts the ball with his forehead.

In a further respect, the invention relates to a head guard for a soccer player including an inner layer of material which contacts the forehead of a player and an outer layer of material which contacts the soccer ball when a player bunts the ball, the outer layer of material being resistant to the absorption of perspiration and remaining substantially dry to enable the material to better frictionally contact and control the soccer ball, the inner layer of material being able to absorb perspiration while maintaining frictional contact with the forehead of the player so that the inner layer will not slide over and burn the forehead when a rapidly spinning soccer ball contacts the head guard.

In still another respect, the invention relates to a head guard which dissipates the rotation of a soccer ball impacting the head guard.

During a game of soccer, a player has occasion to "bunt" an airborne, rotating soccer ball with his forehead. Since a soccer ball typically moves through the air at a substantial velocity, controlling the ball while it is bunted will the forehead is difficult. After a player has been actively moving about a soccer field during a match, perspiration on the head of the player increases the difficulty a player has in controlling the ball during bunting. In addition, when a soccer ball contacts the forehead of a player, the ball imparts compressive and shear forces which can cause tears and can break capillaries in the flesh covering the skull bone of the player.

Accordingly, it would be highly desirable to provide improved apparatus which would, during bunting of a soccer ball, protect the head of a soccer player and facilitate a player's controlling the soccer ball.

Therefore, it is a principal object of the invention to provide improved apparatus for protecting the head of a player during bunting of a soccer ball.

A further object of the invention is to provide a head guard which facilitates the control by a soccer player of a bunted soccer ball.

Another object of the invention is to provide a head guard which absorbs the rotational force of a soccer ball and minimizes the proportion of the rotational force which is transmitted to and must be adsorbed by the forehead of a soccer player.

Still a further object of the invention is to minimize the amount of perspiration which contacts a soccer ball when the ball impacts the head of a soccer ball.

Yet another object of the invention is to provide a head guard which, when impacted by a rotating soccer ball, generally maintains contact with and does not slide over and burn or irritate the skin on the forehead of a soccer player.

These and other, further and more specific objects and advantages of the invention will be apparent to those skilled in the art from the following detailed description thereof, taken in conjunction with the drawings, in which.

Briefly, in accordance with my invention, I provide a head guard for a soccer player. The head guard includes a contact portion; and, means attached to the contact portion to maintain the contact portion in a desired position on the forward portion of the head of a soccer player. The contact portion includes three interconnected layers of material, an inner layer of material for frictionally contacting the forehead of a soccer player and absorbing perspiration therefrom; an outer layer of material for frictionally contacting a soccer ball striking the head guard, the outer layer being resistant to the absorption of perspiration; and, an intermediate layer of resilient material interposed between said inner and outer layers of material. The intermediate layer of material is resiliently laterally displaceable when a rotating soccer ball impacts the contact portion. The resilient lateral displacement of the intermediate layer on contact of the head guard by the soccer ball dissipates the rotational force of the ball and facilitates control of the ball by a soccer player.

Figure 1:
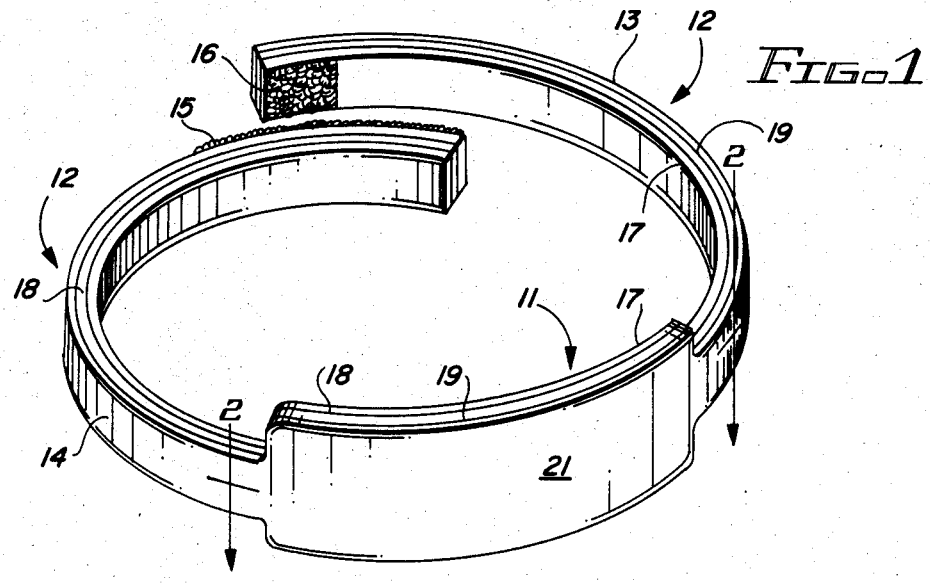
FIG. 1 is a perspective view of a head guard constructed in accordance with the principles of the invention.
Figure 2:
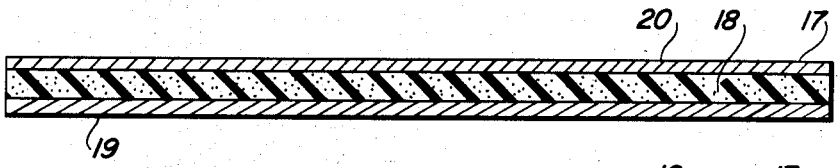
FIG. 2 is a section view of the head guard of FIG. 1 taken along section line 2—2 thereof and further illustrating construction details thereof.
Figure 3:
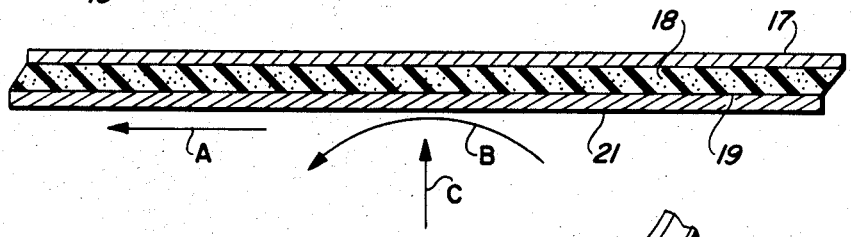
FIG. 3 is a section view of the head guard of FIG. 1 taken along section line 2—2 thereof and illustrating the mode of operation thereof.

Turning now to the drawings in which the presently preferred embodiments of the invention are shown for the purpose of illustrating the practice thereof and not by way of limitation of the scope of the invention, and in which like reference characters represent corresponding elements throughout the several views, FIGS. 1 to 3 illustrate the preferred embodiment of the invention including a contact portion 11 and means 12 attached to the contact portion 11 for maintaining the contact portion 11 in a desired position on the forward portion of the head of a soccer player. In FIG. 1, means 12 comprises a pair of straps 12 and 13 adjustably interconnected by loop 15 and hook 16 material, i.e., interconnected with VELCRO ®. Means 12 can comprise a continuous elastic band or any other desired means for maintaining contact portion 11 in position on the head of a soccer player. Contact portion 11 includes interconnected material layers 17–19. Intermediate layer 18 can be attached to inner layer 17 and outer layer 19 by adhesive, by the normal frictional engagement which occurs when layers of material are placed next to each other, or by any other suitable means. Layer 17 preferably has a relatively smooth inner surface 20 to maximize the total area of surface 20 contacting the forehead of a soccer player. Layer 17 absorbs perspiration from the forehead of a player. Intermediate layer 18 is comprised of a foam or other resilient material which is laterally displaced in the manner indicated by arrow A in FIG. 3 when a rotating soccer ball contacts surface 21 of outer layer 19. In FIG. 3, outer layer 19 and intermediate layer 18 are laterally displaced in the direction of arrow A when the soccer ball contacting portion 11 is rotating in the direction indicated by arrow B. Layer 19 is preferably fabricated from a material which effectively frictionally grips and halts the rotation of a soccer ball and transmits the rotational force of the ball to intermediate layer 18. Layer 18 is elastically laterally displaced to absorb the rotational force of the ball. Layer 19 is presently fabricated from a suede material which is resistant to the absorption of perspiration and other liquids. Inner surface 20 is preferably smooth to protect the skin on the head of a soccer player. If surface 20 of inner layer 17 is fabricated from terry cloth, the individual fabric loops in the terry cloth tend to be impressed into the skin on the head of a player and form a pattern of indents in the skin, especially when a soccer ball impacts portion 11. The forcing of individual fabric loops of a material into the forehead of a player enables the material to effectively "grip" the skin, but also, when a soccer ball contacts portion 11 at high velocity, promotes small tears and damage to capillaries in the skin. Therefore, in the practice of the invention, it is preferred that layer 17 be comprised of a smooth material which frictionally grips the surface of the skin and does not form a "map" of lines or indents in the skin when a soccer ball impacts and compresses portion 11 against the forehead of a player. For example, layer 17 can comprise a soft suede-like material which effectively frictionally engages the surface of the skin on the forehead of a player and which also is able to absorb perspiration. Layer 18 can, if desired, be formed of a resilient material which also absorbs perspiration. It is preferred that layers 17–19 be comprised of materials which "breathe" and facilitate the evaporation of perspiration therethrough.

Layer 18 and, if desired, layers 17 and 19, resiliently absorb a portion of the compressive force generated when a soccer ball impacts portion 11. This compressive impact force is indicated by arrow C in FIG. 3.

Figure 4:
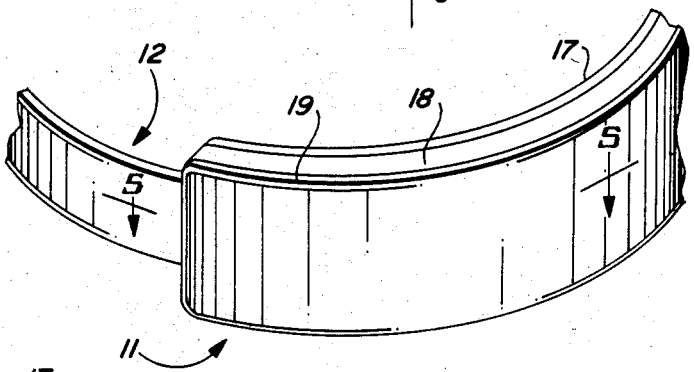
FIG. 4 is a perspective view of an alternate embodiment of the head guard of the invention; and, FIG. 5 is a section view of the head guard of FIG. 4 taken along section line 5—5 thereof.
Figure 5:
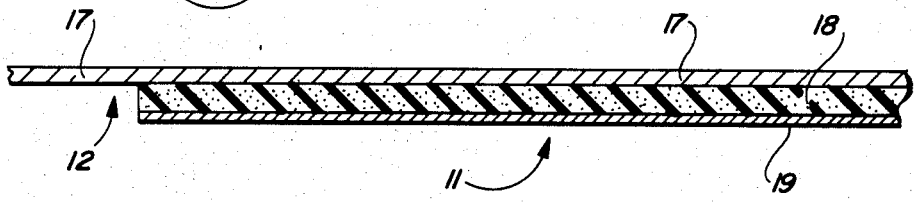

The embodiment of the invention illustrated in FIGS. 4 and 5 includes a contact portion 11 having inner layer 17, intermediate layer 18 and outer layer 19. The material comprising layer 17 also comprises the means 12 utilized to maintain portion 11 in position on the head of a soccer player.

Having described my invention in such terms as to enable those skilled in the art to understand and practice it, and having identified the presently preferred embodiments thereof, I claim:

1. A sandwich construction protective head guard for minimizing injury to the head of a soccer player and enabling the player to more readily control a soccer ball when he bunts the ball with his forehead, including (a) a contact portion including (i) a continuous inner web taking the form of a generally resilient material defining a central layer in the contact portion, (ii) a continuous liner web, taking the form generally of a smooth surfaced skin gripping-fabric jointed to, and substantially coextensive with the inside face of, said inner web, and defining a pliable, perspiration absorbing, inside forehead-gripping layer in the contact portion, and (iii) a continuous contact web taking the form generally of a pliable, perspiration absorption-resistant and soccer ball gripping fabric, joined to, and substantially coextensive with the outside face of, said inner web, and defining a pliable, soccer ball gripping surface in said contact portion, said three webs having their respective conforming faces bonded by adhesive, said three webs collectively forming said contact portion and co-terminating at common peripheral edges, said inner web and contact web being resiliently laterally displaceable with respect to said liner web and the forehead of a soccer player when a rotating soccer ball impacts said contact portion, said resilient lateral displacement of said contact web and inner web on contact of said head guard by the soccer ball dissipating the rotational force of the ball and facilitating control of the ball by a soccer player, said liner web generally remaining in gripping contact with said forehead when a rotating soccer ball impacts said head guard; and (b) means attached to said contact portion to maintain said contact portion in a desired position on the forehead of a soccer player.

* * * * *